US010315832B2

(12) United States Patent
Ellsworth et al.

(10) Patent No.: US 10,315,832 B2
(45) Date of Patent: Jun. 11, 2019

(54) CONSUMER PRODUCT PACKAGE

(71) Applicant: The Procter & Gamble Company, Cincinnati, OH (US)

(72) Inventors: Justin Alan Ellsworth, Liberty Township, OH (US); Timothy David Reichling, Cincinnati, OH (US); Sheena Marie Mahrle, Liberty Township, OH (US); Karen Elizabeth Lomison, Maineville, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 330 days.

(21) Appl. No.: 15/273,918

(22) Filed: Sep. 23, 2016

(65) Prior Publication Data

US 2018/0086542 A1 Mar. 29, 2018

(51) Int. Cl.

| | |
|---|---|
| ***B65D 83/00*** | (2006.01) |
| ***A45D 40/04*** | (2006.01) |
| ***A45D 34/04*** | (2006.01) |

(52) U.S. Cl.

CPC ..... *B65D 83/0011* (2013.01); *A45D 34/04* (2013.01); *A45D 40/04* (2013.01); *B65D 83/0033* (2013.01); *A45D 2200/055* (2013.01)

(58) Field of Classification Search

CPC ..... B65D 83/0011; B65D 83/0016; B65D 83/0005; B65D 83/0027; B65D 83/0033; A45D 40/04; A45D 34/04; A45D 2200/055; A45D 2040/0025; A45D 40/02; A45D 40/06

See application file for complete search history.

(56) References Cited

U.S. PATENT DOCUMENTS 4,702,399 A 10/1987 Davis
5,000,356 A 3/1991 Johnson et al.
(Continued)

FOREIGN PATENT DOCUMENTS

DE 3139192 4/1983
DE 20 2014 103 450 U1 11/2014
(Continued)

OTHER PUBLICATIONS

U.S. Appl. No. 15/273,868, filed Sep. 23, 2016: all office actions.
(Continued)

*Primary Examiner* — David J Walczak
(74) *Attorney, Agent, or Firm* — Kathleen Y. Carter

(57) ABSTRACT

A dispensing package includes a longitudinal axis; a shell that includes a chamber disposed in the shell, a first end, a plurality of shell protrusions extending downwardly from the first end, and a second end opposite the first end; a screw assembly including a protrusion extending from the screw assembly, the protrusion of the screw assembly constructed to engage at least one of the plurality of shell protrusions, a screw base disposed adjacent to the first end and rotatably associated with the shell, and a spindle extending from coaxially to the longitudinal axis from the screw base through the bottom wall into the chamber, wherein the spindle includes threads disposed about an outer surface of the spindle; and an elevator platform threadably engaged to the threads of the spindle.

25 Claims, 11 Drawing Sheets

(56) References Cited

U.S. PATENT DOCUMENTS

| | | | | |
|---|---|---|---|---|
| 5,007,755 | A | 4/1991 | Thompson | |
| 5,547,302 | A | 8/1996 | Dornbusch et al. | |
| 5,697,531 | A | 12/1997 | Fattori | |
| 5,725,133 | A | 3/1998 | Iaia | |
| 5,839,622 | A | 11/1998 | Bicknell et al. | |
| 5,868,510 | A * | 2/1999 | Lacout | A45D 40/04 401/175 |
| 5,879,096 | A | 3/1999 | Franta et al. | |
| 5,947,621 | A | 9/1999 | Szekely | |
| 5,961,007 | A | 10/1999 | Dornbusch et al. | |
| 6,039,483 | A | 3/2000 | Szekely | |
| 6,143,284 | A | 11/2000 | Bush et al. | |
| 6,299,369 | B1 * | 10/2001 | Baines | A45D 40/04 401/175 |
| 6,447,192 | B1 * | 9/2002 | Butz | A45D 40/04 401/175 |
| 7,086,564 | B1 | 8/2006 | Corrigan | |
| 7,374,360 | B1 | 5/2008 | Szekely | |
| 7,389,894 | B2 | 6/2008 | Danne et al. | |
| 9,265,327 | B2 | 2/2016 | Thulin et al. | |
| 2010/0196079 | A1 | 8/2010 | Bolander et al. | |
| 2010/0217176 | A1 | 8/2010 | Carrara et al. | |
| 2013/0039687 | A1 | 2/2013 | Bolander et al. | |
| 2015/0003885 | A1 | 1/2015 | Wade et al. | |
| 2015/0201735 | A1 | 7/2015 | Swaile et al. | |
| 2016/0174687 | A1 | 6/2016 | Ellsworth | |

FOREIGN PATENT DOCUMENTS

| | | | |
|---|---|---|---|
| EP | 0312165 | | 4/1989 |
| EP | 0 387 213 | B1 | 5/1995 |
| JP | 2011050521 | | 3/2011 |
| JP | 5374342 | | 12/2013 |
| JP | 105249659 | | 1/2016 |
| KR | 20-0416565 | Y1 | 5/2006 |
| KR | 2011-0004036 | U | 4/2011 |
| KR | 2011-0009049 | U | 9/2011 |
| WO | 2009/064762 | A2 | 5/2009 |
| WO | WO 2010/088652 | | 8/2010 |
| WO | 2016/062583 | A1 | 4/2016 |
| WO | 2016/062584 | A1 | 4/2016 |

OTHER PUBLICATIONS

PCT International Search Report, dated Nov. 10, 2017 (14 pages).
PCT International Search Report, dated Nov. 10, 2017 (12 pages).
All Office Actions, U.S. Appl. No. 14/971,943.

* cited by examiner

CONSUMER PRODUCT PACKAGE

BACKGROUND

The consumer products industry is continually releasing a variety of new and improved consumer products. As such, the consumer products industry is continually providing to the consumers a wide variety of product packages to dispense and deliver this ever-growing variety of products. However, each new package platform creates added design, manufacturing, inventory, and ancillary costs. As such, there is a need for improved consumer product packages that can serve as dispensing and delivery packages for multiple products.

SUMMARY

In one aspect, a dispensing package includes a longitudinal axis; a shell including a chamber disposed within the shell, a first end, a plurality of shell protrusions extending downwardly from the first end, and a second end opposite the first end; a screw assembly including a protrusion extending from the screw assembly, the protrusion of the screw assembly constructed to engage at least one of the plurality of shell protrusions, a screw base disposed adjacent to the first end and rotatably associated with the shell, and a spindle extending coaxially to the longitudinal axis from the screw base through the bottom wall into the chamber, wherein the spindle includes threads disposed about an outer surface of the spindle; and an elevator platform threadably engaged to the threads of the spindle.

In another aspect, a dispensing package includes a longitudinal axis; a shell including a chamber disposed within the shell and constructed to contain a consumer product; a first end including a plurality of shell protrusions extending downwardly, and a second end opposite the first end; a screw assembly including a protrusion extending from the screw assembly, the protrusion of the screw assembly constructed to engage at least one of the plurality of shell protrusions, a screw base disposed adjacent to the first end and rotatably associated with the shell, and a spindle extending from the screw base through the bottom wall into the chamber coaxial to the longitudinal axis of the package, wherein the spindle includes threads disposed about an outer surface of the spindle; and an elevator platform threadably engaged to the threads of the spindle, wherein a dose of product defined by the movement of the protrusion of the screw assembly from a first space between a first set of adjacent shell protrusions of the plurality of shell protrusions to a second space between a second set of adjacent protrusions of the plurality of shell protrusions is from about 0.05 g to about 2.0 g.

In yet another aspect, a dispensing package includes a longitudinal axis; a shell, a chamber disposed within the shell and constructed to contain a consumer product, a first end including a plurality of shell protrusions extending downwardly from the first end and a second end opposite the first end; a screw assembly including a protrusion extending from the screw assembly, wherein the protrusion of the screw assembly constructed to engage at least one of the plurality of shell protrusions, a screw base disposed adjacent to the first end and rotatably associated with the shell, and a spindle extending coaxially to the longitudinal axis from the screw base through the bottom wall into the chamber, wherein the spindle including threads disposed about an outer surface of the spindle; and an elevator platform threadably engaged to the threads of the spindle, wherein when the screw base is rotated causing the protrusion of the screw assembly to engage and slide over one of the plurality of shell protrusions, such engagement does not cause the elevator platform to deflect along the longitudinal axis.

DETAILED DESCRIPTION

Figure 1:
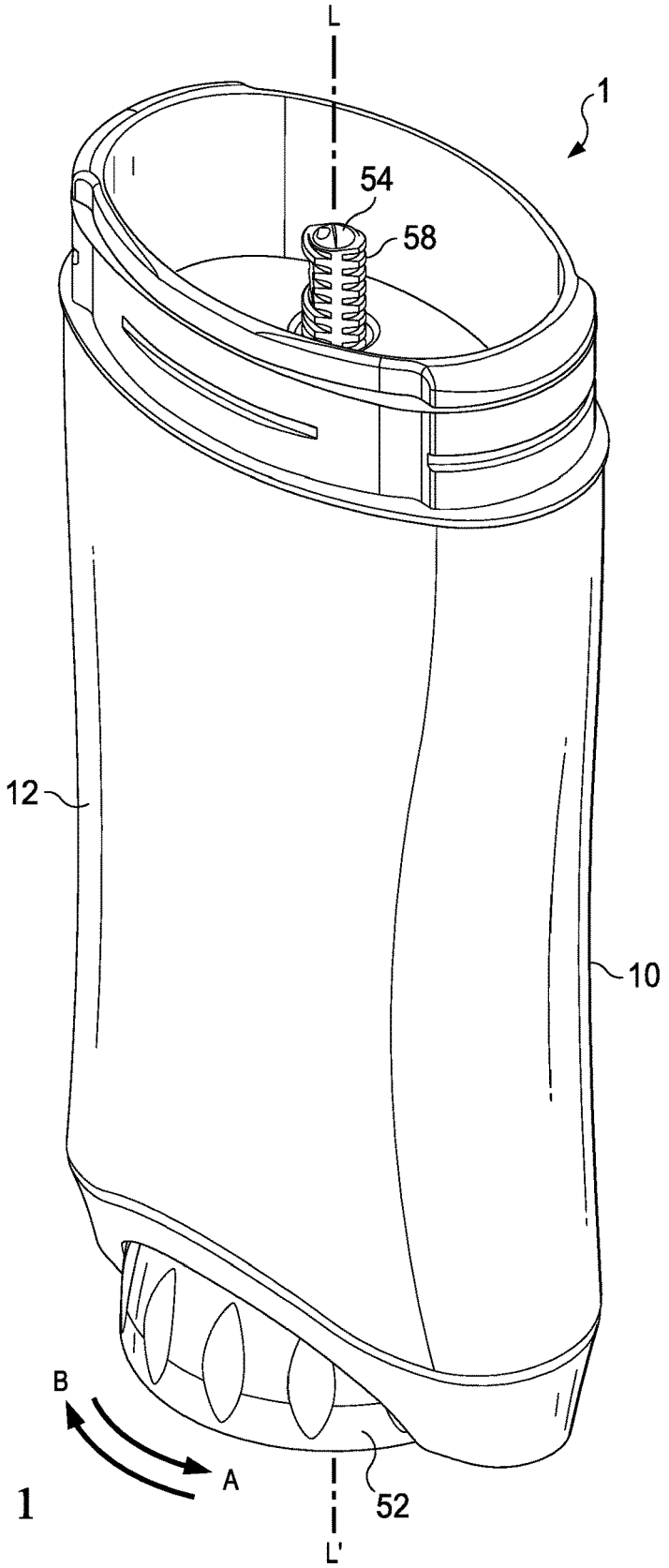
FIG. 1 is a front isometric of a dispensing package according to one or more aspects.
Figure 2:
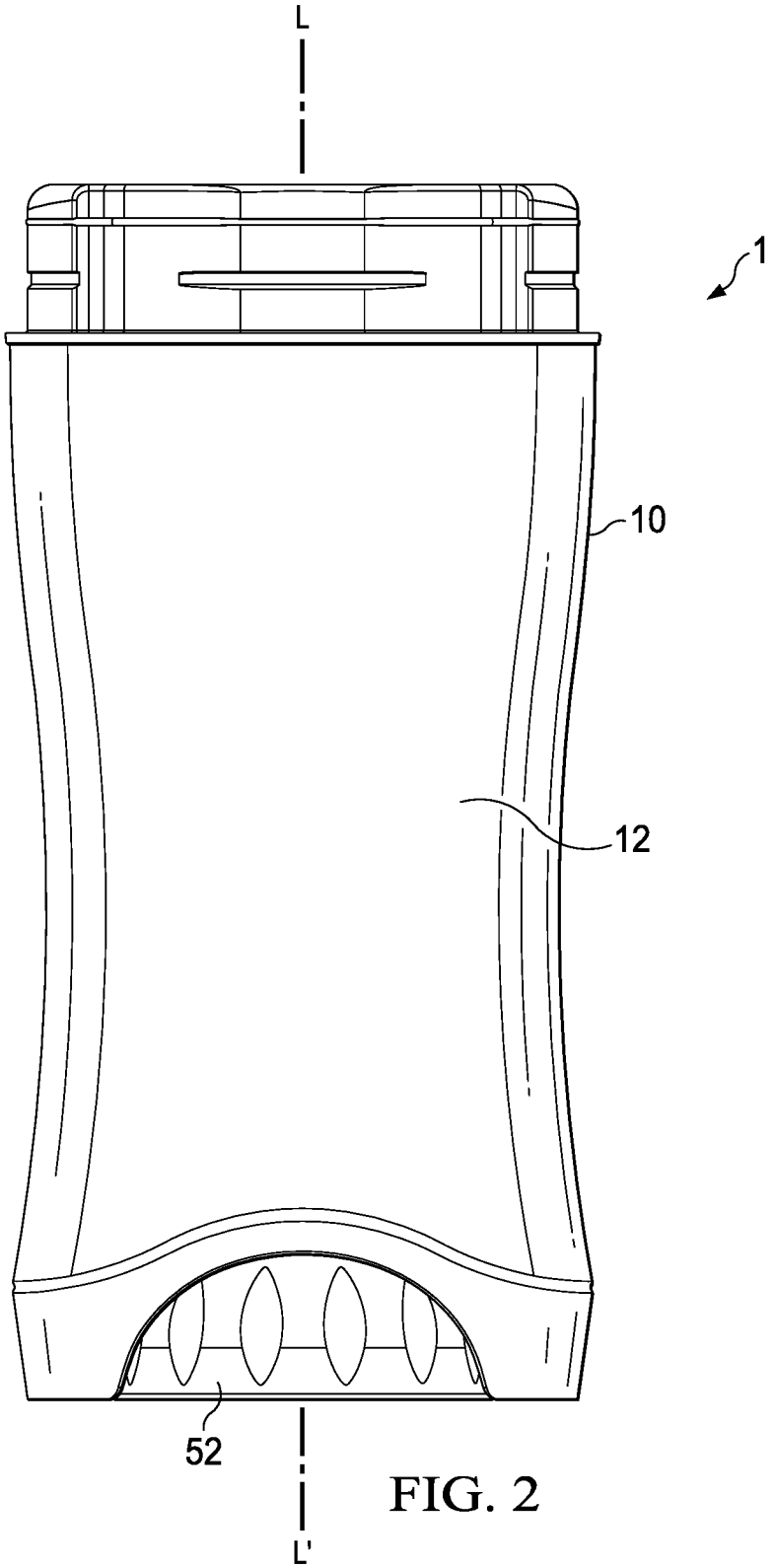
FIG. 2 is a front elevational view of the dispensing package of FIG. 1.
Figure 3:
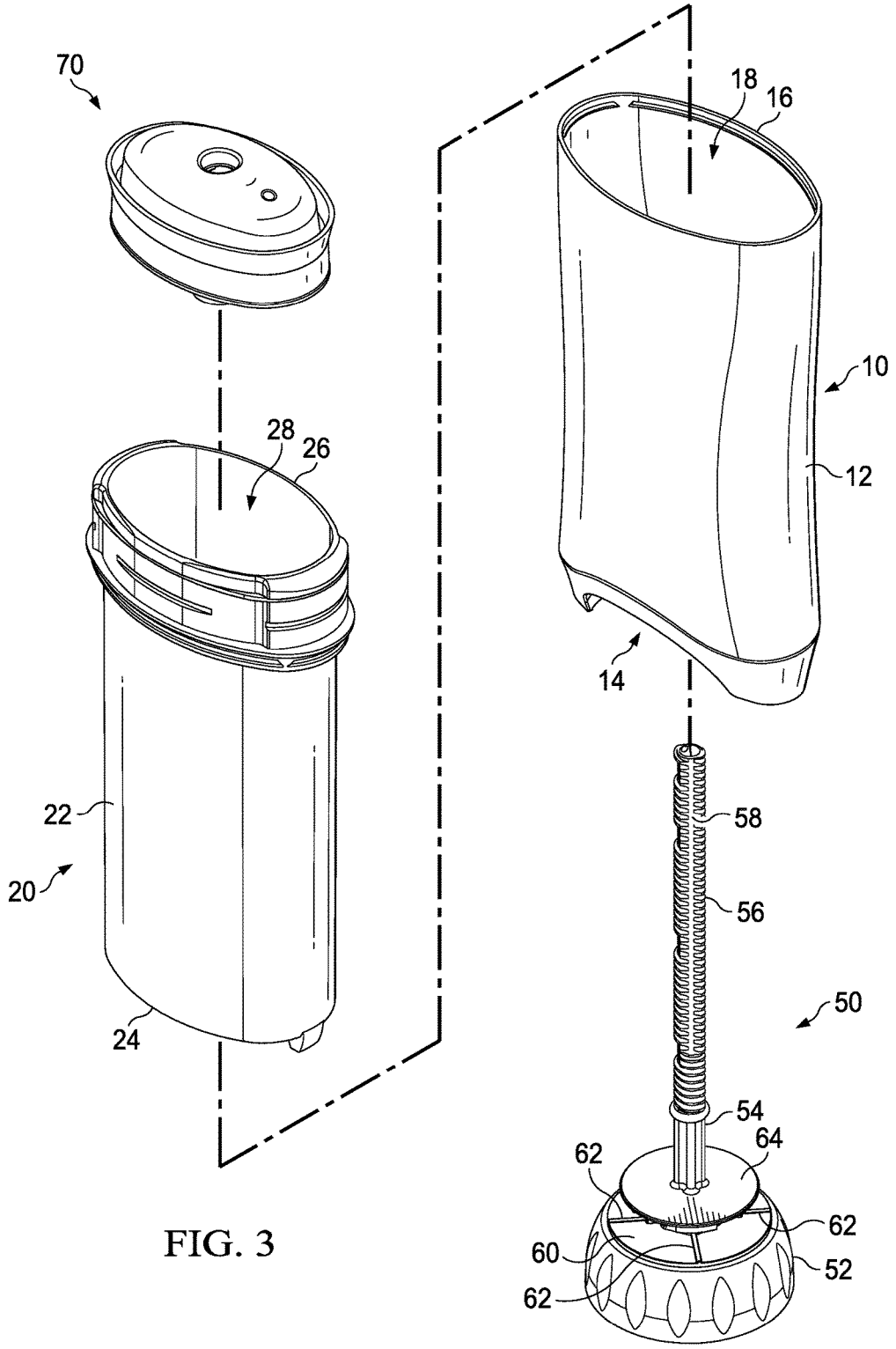
FIG. 3 is an exploded top isometric view of the dispensing package of FIG. 1.
Figure 4:
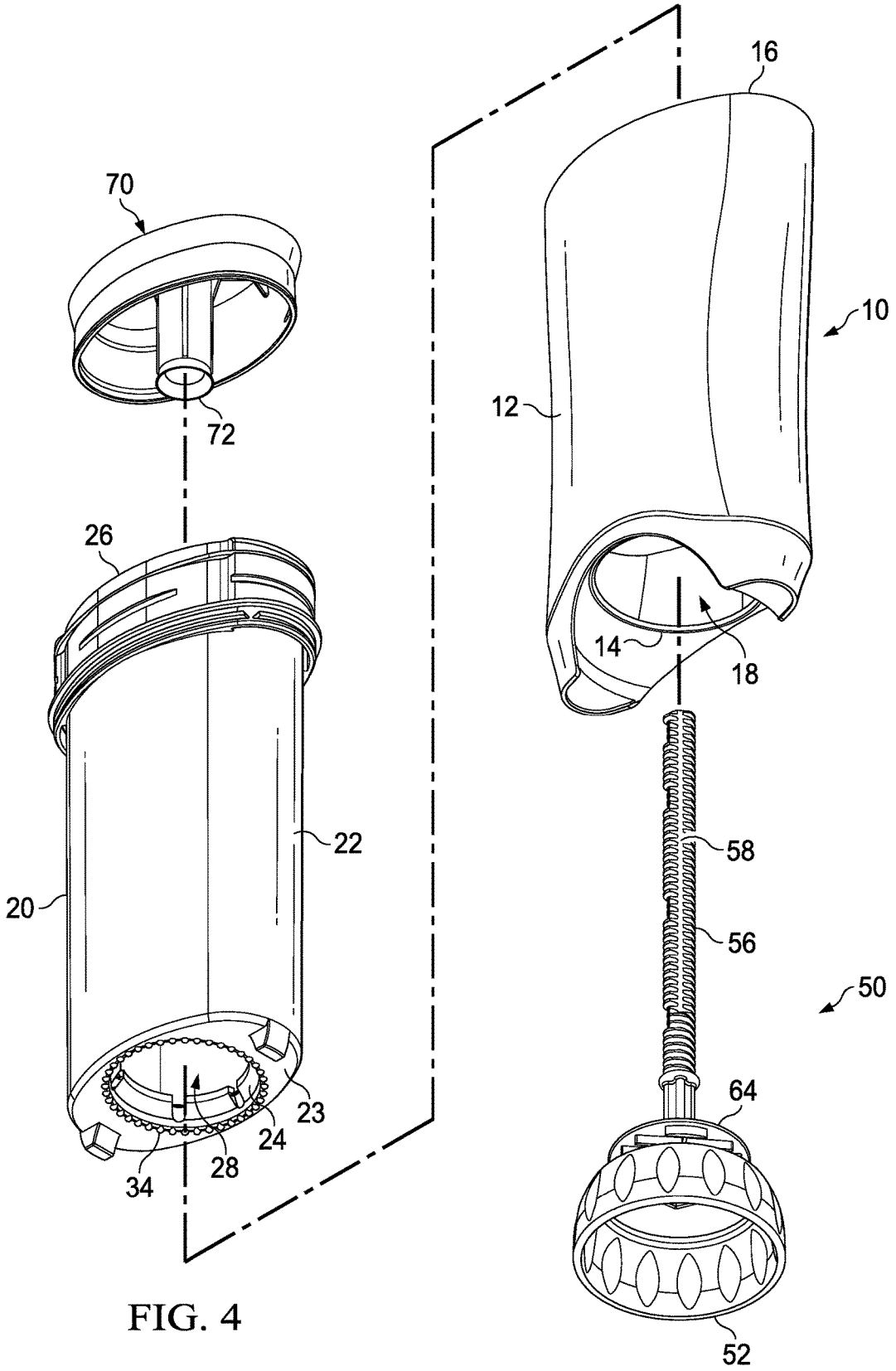
FIG. 4 is an exploded bottom isometric view of the dispensing package of FIG. 1.
Figure 5:
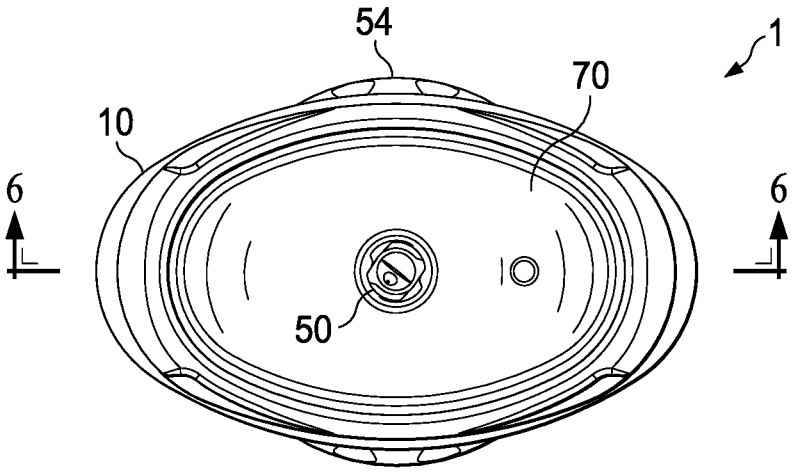
FIG. 5 is a top planar view of the dispensing package of FIG. 1.
Figure 7:
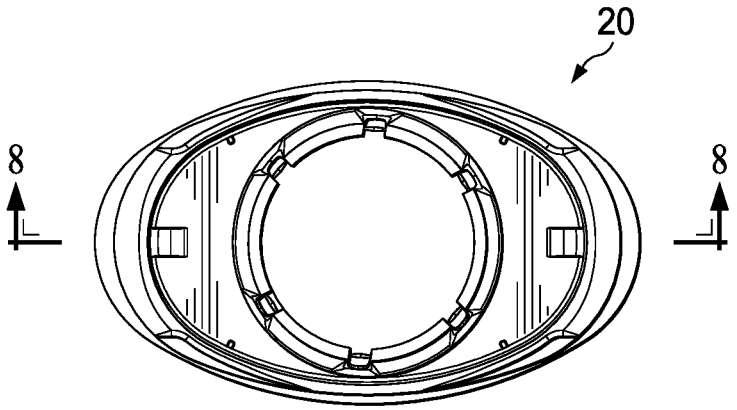
FIG. 7 is bottom planar view of the dispensing package of FIG. 1.

The following text sets forth a broad description of numerous different aspects. The description is to be construed as exemplary only and does not describe every possible aspect since describing every possible aspect would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative aspects could be implemented, using either current technology or technology developed after the filing date of this patent, which would still fall within the scope of the claims.

It should also be understood that, unless a term is expressly defined in this specification, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential unless so stated. To the extent that any term recited in the claims at the end of this patent is referred to in this patent in a manner consistent with a single meaning, that is done for sake of clarity only so as to not confuse the reader, and it is not intended that such a claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

In one or more aspects described and shown herein, the personal care product or composition may be an antiperspirant and deodorant composition which can be formulated as any known or otherwise effective product suitable for delivering an antiperspirant and deodorant active to the desired area of the skin. Nonlimiting examples of such product forms include liquids such as roll-ons; solids such as gel solids, solid sticks, and suspensoids; semi-solids/liquids such as soft solids, creams and lotions.

The one or more aspects of the dispensing package described and shown herein may dispense these personal care compositions which are intended for topical application to the underarm or other suitable areas of the skin. The personal care composition may be deodorant and antiperspirant compositions. The personal care composition may comprise an active ingredient and a suspending or thickening agent incorporated into a suitable liquid carrier. In this context, the term "active" may be antiperspirant actives, deodorant actives, or fragrances, and include any known or otherwise safe and effective antiperspirant, deodorant, or fragrance active material. The terms "antiperspirant active" and "deodorant active" may be topical materials which can prevent, decrease, or eliminate malodors and/or perspiration wetness.

The term "fragrance" as used herein specifically refers to any topical material which covers or masks malodors resulting from perspiration, or which otherwise provides the composition with the desired perfumed aroma.

In some aspects, the personal care product includes a composition that does not weep under pressure, including but not limited to, compositions that do not include silicone, functional equivalents, or the like.

Referring to FIGS. 1 to 9, an illustrative dispensing package is shown as 1. The dispensing package 1 includes a longitudinal axis L-L'. In some aspects the dispensing package 1 may include an outer shell 10. The outer shell 10 may comprise any variety of shapes, sizes, designs, and/or configurations. In some aspects, such as the one shown in the figures, the outer shell 10 may include a side wall 12, a first open end 14, and a second open end 16, opposite the first open end. The side wall 12 may form a chamber 18 therein, connecting the first and second open ends 14 and 16, respectively. In some aspects, the chamber 18 may be constructed to receive a second shell that is at least partially inserted therein (e.g., inner shell 20 shown and described below).

Figure 8:
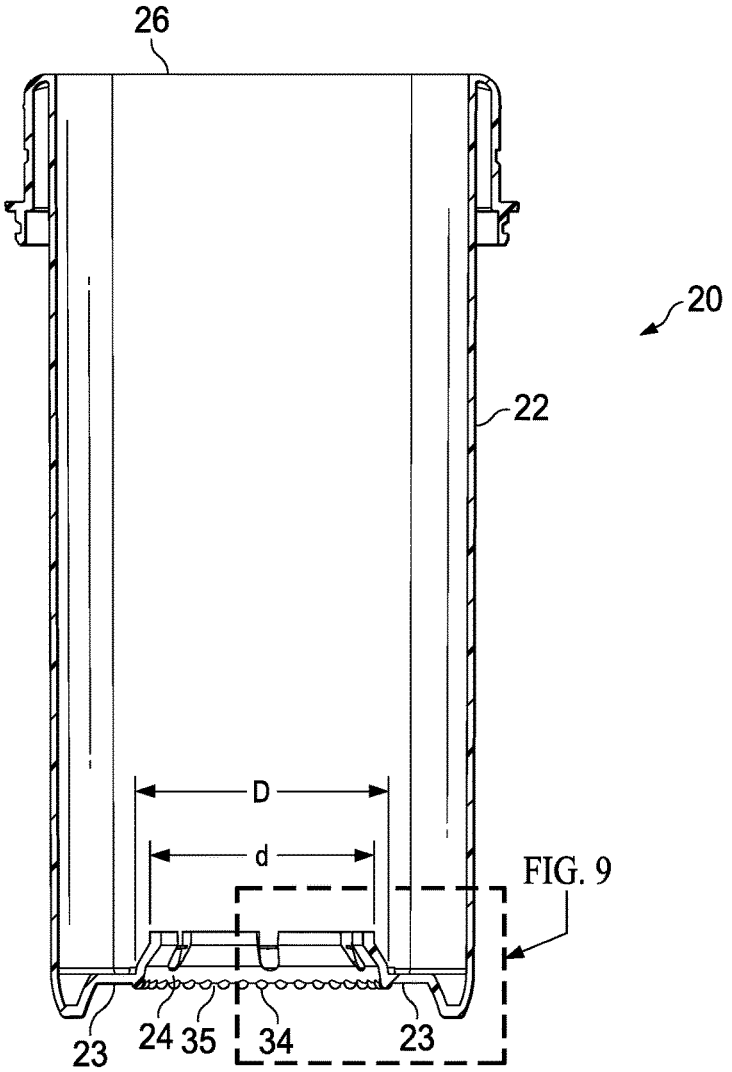
FIG. 8 is a cross sectional view of an inner shell of the dispensing package of FIG. 7.
Figure 9:
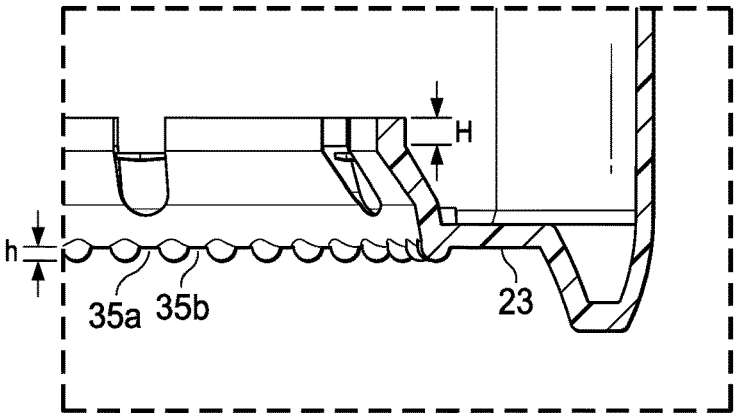
FIG. 9 is a detail view of the inner shell of FIG. 8.

The dispensing package 1 may further include an inner shell 20 that may insert at least partially into the chamber 18 of the outer shell 10. In some aspects the outer shell 10 and inner shell 20 are coaxially-aligned with each other along the longitudinal axis L-L'. In some aspects such as the one shown in the figures, the inner shell 20 may include a side wall 22, a bottom wall 23, a first open end or opening 24 disposed through the bottom wall, and a second open end or opening 26, opposite the first open end. The side wall 22 and bottom wall 23 of the inner shell may form a chamber 28 therein, connecting the first and second open ends 24 and 26, respectively. In some aspects, such as the example shown in FIGS. 1-9, the first open end or opening 24 may comprise an angled opening such that first open end or opening 24 may have a first diameter (D) and then angle radially inwardly to a second diameter (d) spaced apart from the first diameter as best shown in FIG. 8. In this aspect, the chamber 28 of the inner shell 20 may be constructed to contain and/or hold a consumer product such as those described herein until the consumer product is dispensed therefrom.

In the aspect shown, the first open end 24 of the inner shell 20 may include a plurality of shell protrusions 34 that extend downwardly away from the first open end 24 and/or the bottom wall 23. In some aspects, each one of the plurality of shell protrusions 34 are disposed sequentially adjacent to the next one of the plurality of shell protrusions 34 about the first open end 24. In some aspects, the first open end 24 is circular in shape and thus the shell protrusions 34 are disposed about the first open end 24 in a circular shape. In the aspect shown, the bottom wall 23 and first open end 24 are integral to the side wall 22. In some aspects, the shell protrusions 34 comprise from about 1 protrusion to about 60 protrusions, from about 10 protrusions to about 50 protrusions, or from about 15 protrusions to about 40 protrusions.

In some aspects, each pair of adjacent protrusions of the plurality of shell protrusions 34 does not include a gap between them. However, in the aspects shown in FIGS. 1-13, each pair of adjacent protrusions 34 includes a gap 35 (e.g., first gap 35*a*, second gap 35*b*, any subsequent gap 35*n*, shown in, for example, FIG. 9) between them.

Figure 10:
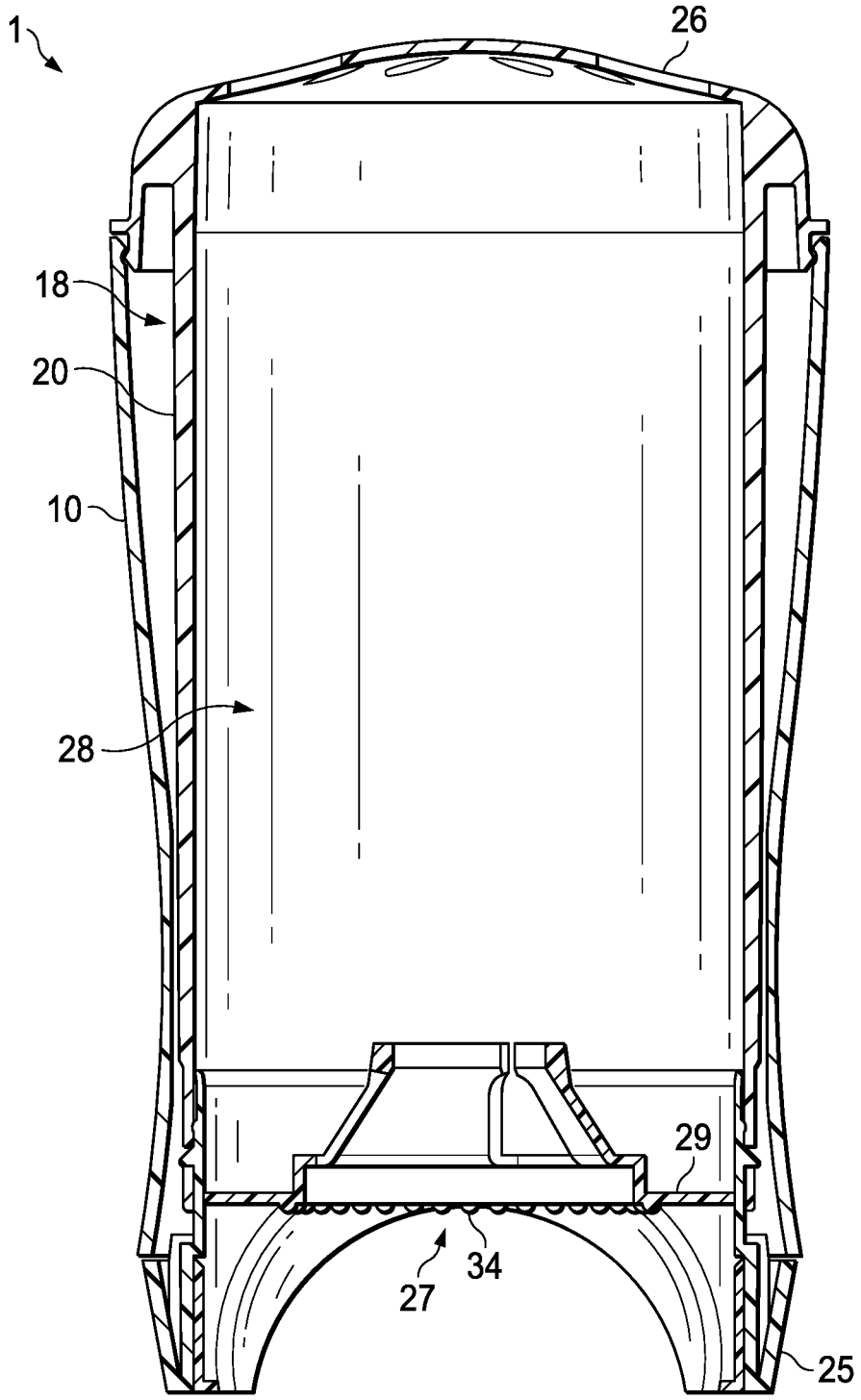
FIG. 10 is a cross sectional view of another dispensing package according to one or more aspects.
Figure 11:
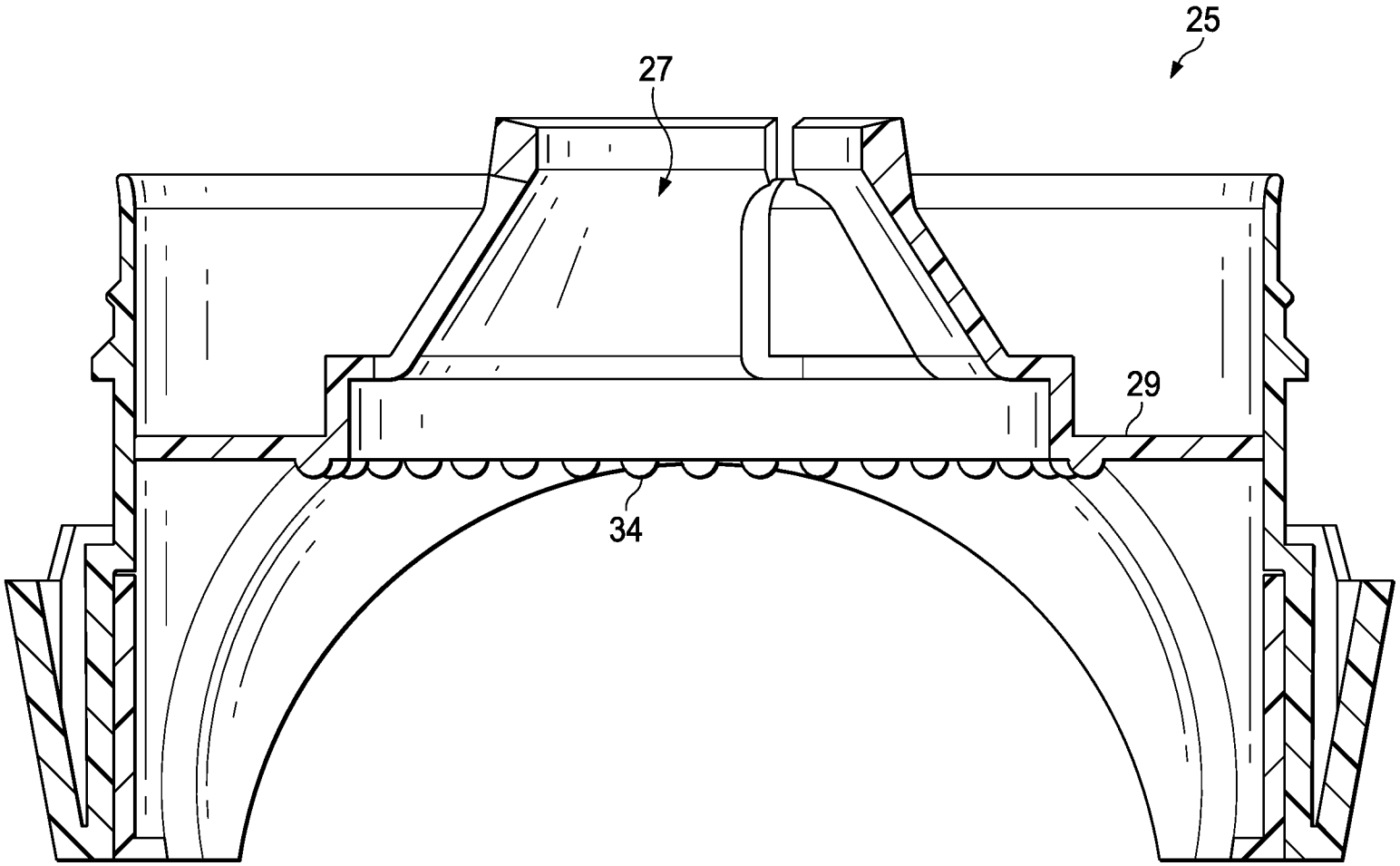
FIG. 11 is a detail, cross sectional view of a plug of the dispensing package of FIG. 10.

Referring to FIGS. 10-11, another aspect of package 1 is shown. The package 1, in this aspect, may include some or substantially all of the same components and features as the aspect described above and shown in FIGS. 1-9. In this aspect, the inner shell 20 does not include a bottom wall integrally connected to the side wall 22. As such, the side wall 22 forms the first end opening 24. Instead, the inner shell 20 includes an attachable bottom wall or plug 25 that may be inserted into the first open end 24 and connected and/or sealed to the side wall 22 at the first open end 24 as conventionally known. In some aspects such as the one shown, the plug 25 snap-fits into the inner shell 20 via snap tabs that insert into snap apertures. In some aspects the plug 25 is welded to the inner shell 20.

The plug 25 may include an opening 27 centrally positioned and disposed therethrough. As shown, the opening may be an angled opening such that at one end the opening may have a first diameter (D) and then angle inwardly to a second diameter (d). The bottom wall or plug 25 may include the plurality of shell protrusions 34 extending downwardly away from the bottom wall (or a portion of bottom wall such as, for example, plug wall 29) and disposed about the opening 27. In other words, the bottom wall, its opening, and the shell protrusions 34 are not integrally formed with the side wall 22 (i.e., a plug-style package) as shown and described above with regard the first aspect.

Figure 12:
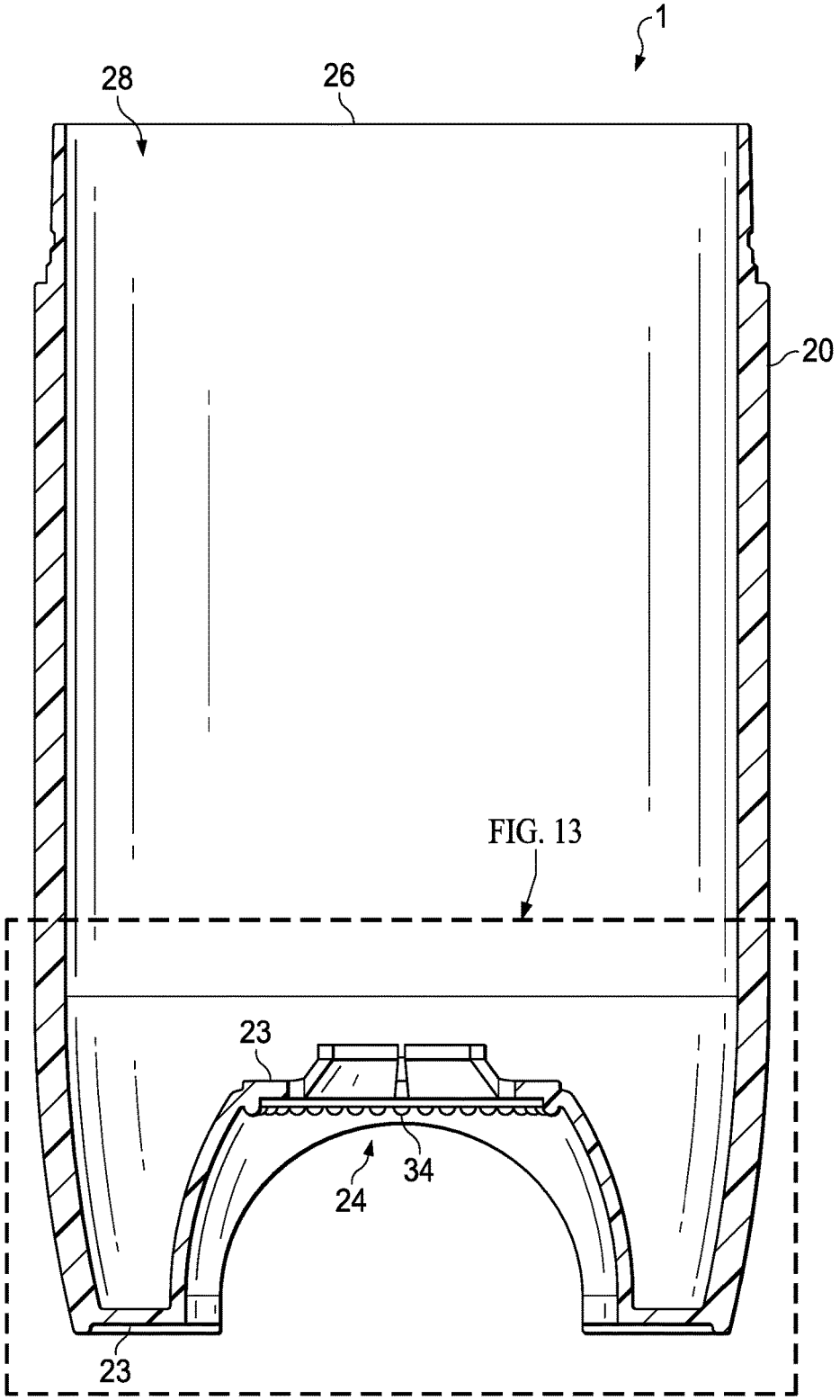
FIG. 12 is a cross sectional view of another dispensing package according to one or more aspects.
Figure 13:
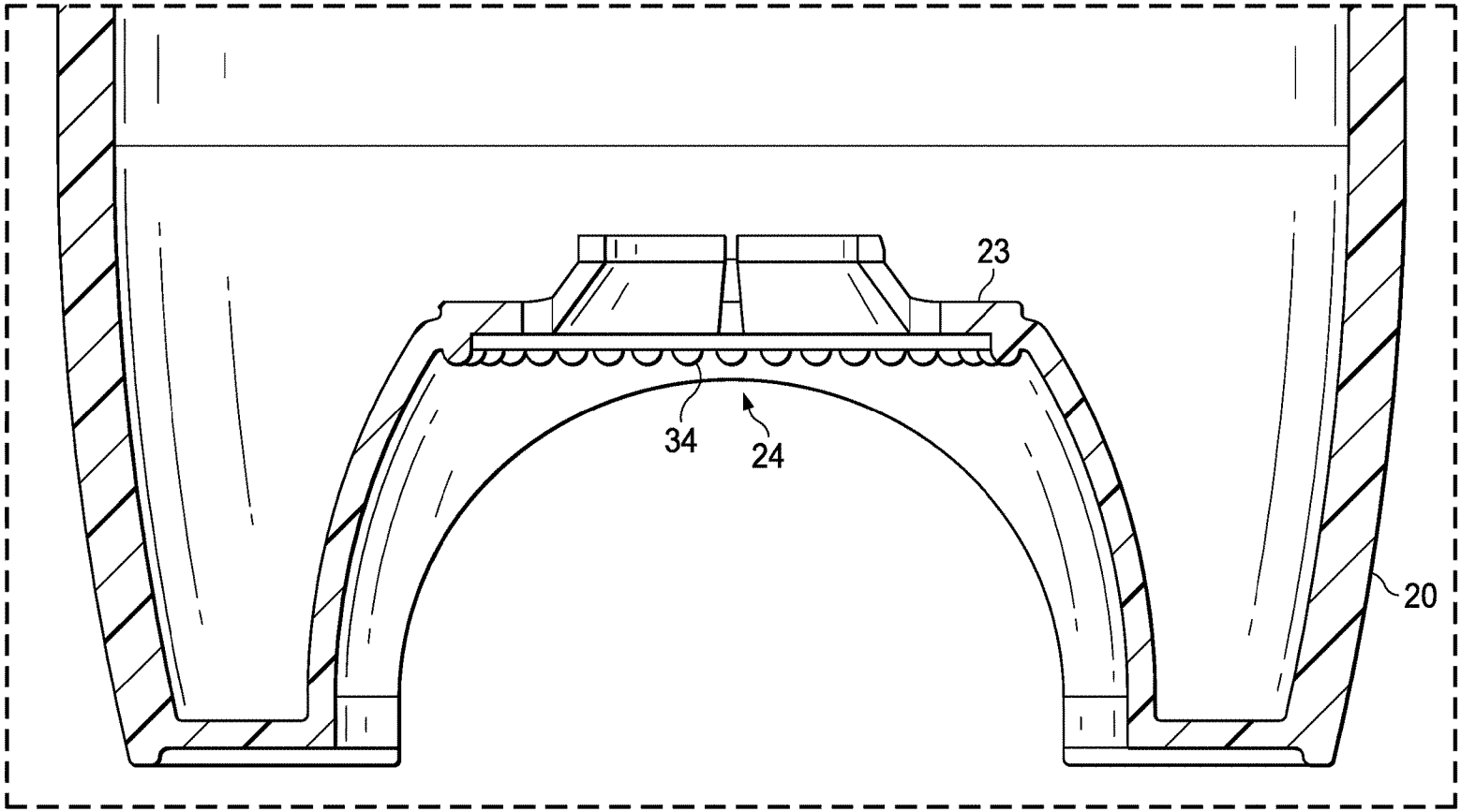
FIG. 13 is a detail view of the dispensing package of FIG. 12.

Referring to FIGS. 12-13, another aspect of package 1 is shown. In this aspect, the package 1 does not include a separate outer shell 10. Rather, shell 20 acts as both an inner and outer shell. Shell 20 may include some of or all of the features and components of the one or more aspects shown and described above herein. As shown in FIGS. 12-13, the aspect includes the plurality of shell protrusions 34 extending downwardly from the first open end 24 and/or from the bottom wall 23.

The shell protrusions 34 described and shown above are only examples of one or more configurations. It is understood that the shell protrusions 34 in the one or more aspects set forth above herein may include any variety of types of protrusions having any variety of shapes, sizes, designs, and configurations, including but not limited to nubs, pawls, tabs, ramps, cams, teeth, ratchet teeth, the like, and/or combinations thereof. In the aspects shown in FIGS. 1-13, the protrusions 34 are shell pawls.

In some aspects, the shell protrusions 34 may including teeth having a cam surface (not shown) and a side wall (not shown), but well known in the art and as described and shown in co-pending, commonly-owned U.S. patent application Ser. No. 14/971,943, titled Package for Consumer Care Products, filed Dec. 16, 2015; U.S. Pat. No. 5,000,356, Johnson et al., issued Mar. 19, 1991, P&G; U.S. Pat. No. 6,039,483, Szekely, issued Mar. 21, 2000, The Plastek Group, all of which are incorporated by reference herein. The chamber teeth may have a height (H) from about 0.010 in. to about 0.100 in. The cam surface may also have a cam angle a from about 10 degrees to about 75 degrees, form about 15 degrees to about 50 degrees, from about 30 degrees to about 50 degrees, or from about 40 degrees to about 45 degrees. In some aspects, cam angle a is about 20 degrees. These teeth and their position on the inner shell 20 may be constructed to not provide pressure relief to the product contained within the chamber 20.

In the aspect shown in FIGS. 1-13, the protrusions 34 are pawls or nubs having a height (h) from about 0.005 in. to about 0.060 in., or from about 0.010 in. to about 0.050 in., or from about 0.025 to about 0.040 in. In some aspects, the protrusions 34 are constructed in order to provide no pressure relief to reduce and/or eliminate weeping of the product contained within the chamber 28. In this aspect, the protrusions 34 are positioned about the first open end 24 such that there is the gap 35 between each adjacent pair of protrusions 34 (e.g., first gap 35*a*, second gap, etc.). The protrusions 34 are constructed to provide micro-dosing indicia to the consumer through audio queues such as, an audio signal (e.g., a "clicking" sound) and/or tactile queues such as resistance to the rotation of the screw base 52. In some aspects, a micro-dose may comprise a dose of product from about 0.05 grams to about 2.0 grams (e.g., per click), or from about 0.05 grams to about 0.19 grams (e.g., per click), or from 0.05 grams (e.g., per click) to about 0.15 grams (e.g., per click), or less than about 0.2 grams (e.g., per click). It is understood that such doses may also be provided by requiring multiple clicks to achieve such dosage.

It should also be understood that, in some aspects, the plurality of shell protrusions 34 may also be disposed at the first open end 14 of the outer shell 10 rather than the first open end 24 of the inner shell 20.

Still referring to FIGS. 1-13, in one or more of the aspects described and shown above herein, the dispensing package 1 may include a screw assembly 50. The screw assembly 50 may be partially or fully inserted into the first open end 24 of the inner shell 20. The screw assembly 50 may include a screw base 52, a spindle 54 extending from the screw base 52 and having an outer surface 56, and threads 58 disposed along the outer surface 56 about at least a portion of the spindle 54.

Figure 6:
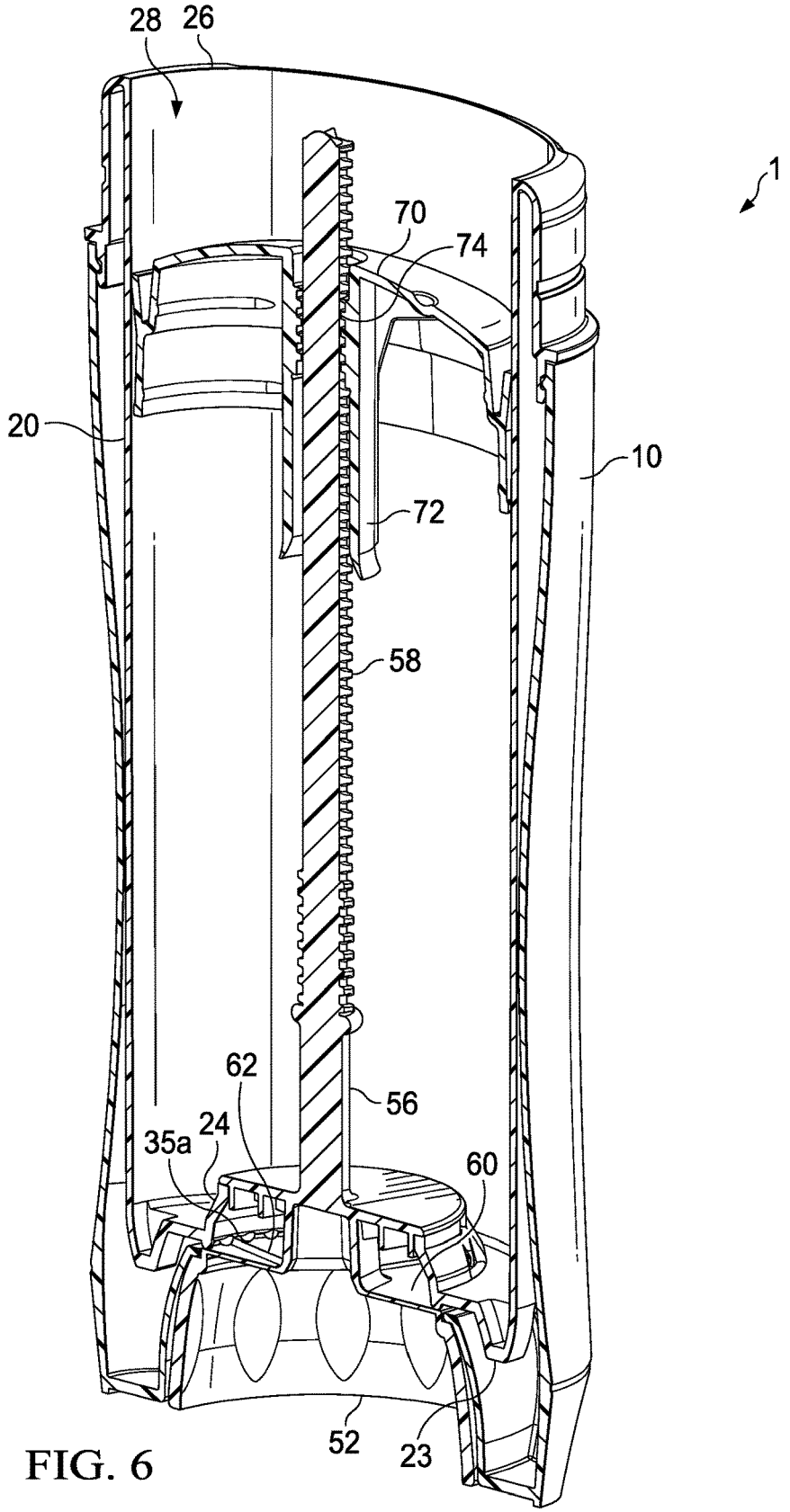
FIG. 6 is a cross sectional view of the dispensing package of FIG. 5.

The screw base 52 may include one or more protrusions extending upwardly from the screw base. In the aspect shown in the figures, the screw base 52 may include a top surface 60 and protrusions 62 (e.g., four protrusions) extending upwardly from the base 52. The protrusions 62 extend radially outward from the center of the screw base 52 (and the longitudinal axis L-L') and are spaced apart about 90 degrees from each other. The screw assembly 50 and protrusions 62 are constructed such that each one of the protrusions 62 may engage at least one of the shell protrusions 34 when the screw assembly 50 is inserted within the first open end 24 of the inner shell 20. The screw assembly 50 may be partially or fully inserted into the first open end 24 of the inner shell 20 such that the spindle 54 is movably associated with and disposed within the chamber 28. As shown in FIG. 6, for example, each one of the protrusions 62 may be positioned within a first space (e.g., first space 35*a*, FIG. 9) between adjacent protrusions of the second plurality of protrusions 34 when the screw assembly 50 is assembled with at least the inner shell 20.

The package 1 may also include an elevator platform 70 movably engaged to the spindle 54 of the screw assembly 50. As shown in FIG. 6, the elevator platform 70 may include an aperture 72 disposed therethrough having internal threads 74. The external threads 58 of the spindle 54 are constructed to threadingly engage the internal threads 74 of the elevator platform 70. The threads 58 may have a variety of pitches constructed to move the elevator platform 70 a certain linear distance per an entire 360 degree rotation of the screw base 52.

As an example, when a rotational force (e.g., illustrated by arrow A or arrow B) is applied to the screw base 52 by a user, the screw assembly 50, including the spindle 54, rotates causing the threads 58 to rotate within the aperture 72 and moving the elevator platform 70 in a linear direction along the longitudinal axis L-L'. Simultaneously, when the screw base 52 rotates, each one of the protrusions 62 moves from the first space 35*a*, engaging (e.g., sliding up and over the protrusions 34) a respective one of the protrusions 34 and into a second adjacent space 35*b* on the opposite side of the engaged protrusions 34. When the screw assembly 50 is rotated, the elevator platform 70 is displaced a linear length along the longitudinal axis L-L' due to the pitch of the threads 58. In an aspect, the engagement and movement of the protrusions 62 over the protrusions 34 does not displace the elevator platform 70 such as for example, a distance equal to the protrusions (h). Such engagement and movement of the protrusions displaces the screw base 52 downwardly and does not displace or move the elevator platform 70. In other words, in an aspect, the elevator platform is only moved by the pitch of the threads 58 of the spindle and not by the engagement of the protrusions 62 with the protrusions 34.

The movement and/or engagement of the protrusions 62 with the respective protrusions 34 from the first space 35*a* to the subsequent positioning into the second space 35*b* may create an audio queue or signal such as, for example, a "click." It should be understood that the user may continue to rotate and cause the protrusions 62 to engage one or more of the shell protrusions 34 and into one or more of the adjacent spaces 35*n* until a desired dose is achieved. Additionally, such movement and/or engagement of the protrusions 62 with the shell protrusions 34 may provide a resistance to the rotation of the screw base 52 that the user may sense, providing a tactile queue to the user as well. Such queues may identify to the user that a dose of the product has been dispensed. Instructions may be provided to the user, in some aspects, identifying how many "clicks" and/or rotations into adjacent spaces 35*n* are required for a normal product dose. By controlling parameters such as, for example, the shape, size (e.g., height), spacing, and/or frequency of protrusions 34, the user's dosing experience and control is impacted. The protrusions 62 and the shell protrusions 34 may be constructed to not provide pressure relief to the product contained within the chamber 28.

EXAMPLES

1. A dispensing package 1, the dispensing package comprising:
   a longitudinal axis;
   a shell 20 comprising
      a chamber 28 disposed within the shell 20,
      a first end 24, a plurality of shell protrusions 34 extending from the first end 24, and a second end 26 opposite the first end 24;

a screw assembly 50 comprising a protrusion 62 extending from the screw assembly, the protrusion 62 of the screw assembly 50 constructed to engage at least one of the plurality of shell protrusions 34, a screw base 52 disposed adjacent to the first end 24 and rotatably associated with the shell 20, and a spindle 54 extending coaxially to the longitudinal axis from the screw base 52 through the bottom wall 23 into the chamber 28, the spindle 54 including threads 58 disposed about an outer surface 56 of the spindle 54; and an elevator platform 70 threadably engaged to the threads 58 of the spindle 54.

2. The dispensing package according to example 1, wherein a dose defined by the movement of the protrusion 62 of the screw assembly 50 from a first space 35*a* between a first set of adjacent shell protrusions of the plurality of shell protrusions to a second space 35*b* between a second set of adjacent shell protrusions of the plurality of shell protrusions is from about 0.05 g to about 2.0 g.

3. The dispensing package according to example 1 or 2, wherein the dose is from about 0.05 g to about 1.0 g.

4. The dispensing package according any one of the examples 1-3, wherein one of the shell protrusions 34 in the first set and second set of adjacent shell protrusions is in common.

5. The dispensing package according any one of the examples 1-4, wherein the shell 20 further comprises a bottom wall 23 disposed at the first end 24 such that the plurality of shell protrusions 34 extend away from the bottom wall and preferably wherein the shell 20 further comprises a opening 24 disposed within the bottom wall 23 for bottom filling.

6. The dispensing package according to any one of the examples 1-5, wherein the protrusion 62 of the screw assembly 50 comprises a plurality of protrusions extending from the screw assembly, and wherein each one is constructed to engage a shell protrusion 34 of the plurality of shell protrusions.

7. The dispensing package according to example 6, wherein each one of the plurality of shell protrusions 34 extends downwardly from the bottom wall 23, and wherein preferably each one of the plurality of protrusions 62 of the screw assembly 50 extends upwardly from the screw base 52 such that each one the plurality of protrusions 62 of the screw assembly 50 is constructed to engage at least one of the plurality of shell protrusions 34 and wherein preferably the protrusions 62 extending from the screw assembly 50 comprise four protrusions extending from the screw assembly disposed about 90 degrees from each other about the longitudinal axis.

8. The dispensing package according any one of the examples 5 or 7, wherein the bottom wall is a plug 25 that is constructed to insert into and connect to an open end disposed at the first end 24 of the shell 20 after filling the chamber 28 with product.

9. The dispensing package according any one of the examples 1-6, wherein the plurality of shell protrusions 34 extend upwardly away the bottom wall 23, and wherein the screw assembly 50 preferably further comprises a platform 64 extending radially from the spindle 54 and spaced apart from the screw base 52, and wherein each one of the plurality of protrusions 62 of the screw assembly 50 extend downwardly from the platform and is constructed to engage a protrusion of the plurality of shell protrusions 34.

10. The dispensing package according any one of the examples 1-9, wherein when the screw base 52 is rotated causing the protrusion 62 of the screw assembly 50 to engage and slide over one of the plurality of shell protrusions 34, such engagement does not cause the elevator platform 70 to deflect along the longitudinal axis.

11. The dispensing package according any one of the examples 1-10, wherein the plurality of shell protrusions 34 comprises from 1 protrusion to 60 protrusions, preferably from 10 protrusions to 50 protrusions, and preferably the plurality of shell protrusions have a height (h) from about 0.005 in to about 0.060 in.

12. The dispensing package according any one of the examples 1-11, wherein the plurality of shell protrusions 34 or the plurality of protrusions 62 of the screw assembly 50 are selected from the following group of protrusions: teeth, pawls, ratchet, cams, ramps, and combinations thereof and preferably the plurality of shell protrusions and the plurality of protrusions of the screw assembly are non-removably associated with the chamber.

13. The dispensing package according any one of the examples 1-12, wherein the screw assembly 50 is removably attached to the chamber 28.

14. The dispensing package according any one of the examples 1-13, further comprising an outer shell 10.

15. The dispensing package according to example 1, wherein the chamber 28 disposed within the shell 20 and is constructed to contain a consumer product, and wherein a dose of the product is defined by the movement of the protrusion 62 of the screw assembly 50 from a first space 35*a* between a first set of adjacent shell protrusions of the plurality of shell protrusions 34 to a second space 35*b* between a second set of adjacent protrusions of the plurality of shell protrusions 34 is from about 0.05 g to about 2.0 g.

16. A dispensing package according to example 1 wherein when the screw base 52 is rotated causing the protrusion 62 of the screw assembly 50 to engage and slide over one of the plurality of shell protrusions 34, such engagement does not cause the elevator platform 70 to deflect along the longitudinal axis.

It should be understood that any feature and/or element of any one of the aspects and/or examples shown and described above herein may be removed from the aspect and/or example, replaced with a feature or element from another aspect or example herein or replaced with an equivalent feature or element.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dispensing package, the dispensing package comprising:

a longitudinal axis;

a shell comprising a chamber disposed within the shell, a first end, a plurality of from 10 to about 60 shell protrusions;

a bottom wall;

a screw assembly comprising a protrusion extending from the screw assembly, the protrusion of the screw assembly constructed to engage at least one of the plurality of shell protrusions, a screw base disposed adjacent to the first end and rotatably associated with the shell, and a spindle extending coaxially to the longitudinal axis from the screw base through the bottom wall into the chamber, the spindle including threads disposed about an outer surface of the spindle; and an elevator platform threadably engaged to the threads of the spindle.

2. The dispensing package of claim 1, wherein a dose defined by the movement of the protrusion of the screw assembly from a first space between a first set of adjacent shell protrusions of the plurality of shell protrusions to a second space between a second set of adjacent shell protrusions of the plurality of shell protrusions is from about 0.05 g to about 2.0 g.

3. The dispensing package of claim 2, wherein when the screw base is rotated causing the protrusion of the screw assembly to engage and slide over one of the plurality of shell protrusions, such engagement does not cause the elevator platform to deflect along the longitudinal axis.

4. The dispensing package of claim 2, wherein the screw assembly is removably attached to the chamber.

5. The dispensing package of claim 2, further comprising an outer shell disposed at least partially over the chamber.

6. The dispensing package of claim 2, wherein the chamber contains an antiperspirant or deodorant.

7. The dispensing package of claim 6, wherein the antiperspirant or deodorant comprises a cream or gel.

8. The dispensing package of claim 2, wherein the dose is from about 0.05 g to about 1.0 g.

9. The dispensing package of claim 2, wherein one of the shell protrusions in the first set and one of the shell protrusions in the second set of adjacent shell protrusions is the same.

10. The dispensing package of claim 1, wherein the bottom wall is disposed at the first end such that the plurality of shell protrusions extend away from the bottom wall.

11. The dispensing package of claim 10, wherein the shell further comprises a bottom opening disposed within the bottom wall for bottom filling.

12. The dispensing package of claim 11, wherein the protrusion of the screw assembly comprises a plurality of protrusions extending from the screw assembly, and wherein each one is constructed to engage a shell protrusion of the plurality of shell protrusions.

13. The dispensing package of claim 12, wherein the screw assembly further comprises a platform extending radially from the spindle and spaced apart from the screw base, and wherein each one of the plurality of protrusions of the screw assembly extend downwardly from the platform and is constructed to engage a protrusion of the plurality of shell protrusions.

14. The dispensing package of claim 12, wherein the plurality of protrusions of the screw assembly are selected from the following group of protrusions: teeth, pawls, ratchet, cams, ramps, and combinations thereof.

15. The dispensing package of claim 14, wherein the plurality of shell protrusions have a height (h) from about 0.005 in to about 0.060 in.

16. The dispensing package of claim 12, wherein the plurality of shell protrusions and the plurality of protrusions are non-removably associated with the chamber.

17. The dispensing package of claim 12, wherein each one of the plurality of shell protrusions extends downwardly from the bottom wall, and wherein each one of the plurality of protrusions of the screw assembly extends upwardly from the screw base such that each one the plurality of protrusions of the screw assembly is constructed to engage at least one of the plurality of shell protrusions.

18. The dispensing package of claim 17, wherein plurality of protrusions extending from the screw assembly comprises four protrusions extending from the screw assembly disposed about 90 degrees from each other about the longitudinal axis.

19. The dispensing package of claim 10, wherein the bottom wall is a plug that is constructed to insert into and connect to an open end disposed at the first end of the shell after filling the chamber with product.

20. The dispensing package of claim 19, wherein the protrusion of the screw assembly comprises a plurality of protrusions extending from the screw assembly, and wherein each one is constructed to engage a protrusion of the plurality of shell protrusions.

21. The dispensing package of claim 20, wherein each one of the plurality of protrusions extending from the screw assembly extends upwardly from the screw base such that each one of the plurality of protrusions of the screw assembly is constructed to engage at least one of the plurality of shell protrusions.

22. The dispensing package of claim 1, wherein the plurality of shell protrusions are disposed about the first end of the chamber in a substantially circular-shape.

23. The dispensing package of claim 1, wherein the plurality of shell protrusions comprises from about 15 protrusions to about 40 protrusions.

24. A dispensing package, the dispensing package comprising:

a longitudinal axis;

a shell comprising a chamber disposed within the shell and constructed to contain a consumer product, a first end including a plurality of from 10 to about 60 shell protrusions extending downwardly, and a second end opposite the first end;

a bottom wall;

a screw assembly comprising a protrusion extending from the screw assembly, the protrusion of the screw assembly constructed to engage at least one of the plurality of shell protrusions, a screw base disposed adjacent to the first end and rotatably associated with the shell, and a spindle extending from the screw base through the bottom wall into the chamber coaxial to the longitudinal axis of the package, the spindle including threads disposed about an outer surface of the spindle; and an elevator platform threadably engaged to the threads of the spindle;

wherein a dose of product defined by the movement of the protrusion of the screw assembly from a first space between a first set of adjacent shell protrusions of the plurality of shell protrusions to a second space between a second set of adjacent protrusions of the plurality of shell protrusions is from about 0.05 g to about 2.0 g.

25. A dispensing package, the dispensing package comprising:

a longitudinal axis;

a shell comprising a chamber disposed within the shell and constructed to contain a consumer product, a first end including a plurality of shell protrusions extending downwardly from the first end, and a second end opposite the first end;

a bottom wall;

a screw assembly comprising a protrusion extending from the screw assembly, the protrusion of the screw assembly constructed to engage at least one of the plurality of shell protrusions, a screw base disposed adjacent to the first end and rotatably associated with the shell, and a spindle extending coaxially to the longitudinal axis from the screw base through the bottom wall into the chamber, the spindle including threads disposed about an outer surface of the spindle; and an elevator platform threadably engaged to the threads of the spindle;

wherein when the screw base is rotated causing the protrusion of the screw assembly to engage and slide over one of the plurality of shell protrusions, such engagement does not cause the elevator platform to deflect along the longitudinal axis.

* * * * *